US010370801B2

(12) United States Patent
Pinson

(10) Patent No.: US 10,370,801 B2
(45) Date of Patent: Aug. 6, 2019

(54) PAVER

(71) Applicant: STABILCORP PTY LTD, Wauchope, New South Wales (AU)

(72) Inventor: Craig Steven Pinson, Wauchope (AU)

(73) Assignee: STABILCORP PTY LTD, Wauchope, New South Wales (AU)

( * ) Notice: Subject to any disclaimer, the term of this patent is extended or adjusted under 35 U.S.C. 154(b) by 2 days.

(21) Appl. No.: 15/574,508

(22) PCT Filed: May 19, 2016

(86) PCT No.: PCT/AU2016/050380

§ 371 (c)(1),
(2) Date: Nov. 16, 2017

(87) PCT Pub. No.: WO2016/183632

PCT Pub. Date: Nov. 24, 2016

(65) Prior Publication Data

US 2018/0127929 A1 May 10, 2018

(30) Foreign Application Priority Data

May 19, 2015 (AU) ..... 2015901814
Sep. 10, 2015 (AU) ..... 2015903690
May 4, 2016 (AU) ..... 2016901643

(51) Int. Cl.
*E01C 19/48* (2006.01)

(52) U.S. Cl.
CPC ..... *E01C 19/48* (2013.01); *E01C 2301/16* (2013.01)

(58) Field of Classification Search
CPC ..... E01C 19/42; E01C 19/48; E01C 19/43; E01C 2301/14; E01C 2301/16
See application file for complete search history.

(56) References Cited

U.S. PATENT DOCUMENTS 2,403,820 A * 7/1946 Miller ..... E01C 19/4873 280/504
2,954,241 A * 9/1960 Warren ..... E01C 19/4873 280/460.1
3,095,788 A * 7/1963 Odell ..... B60P 3/00 280/460.1
3,213,769 A * 10/1965 Smith ..... E01C 19/43 280/460.1

(Continued)

OTHER PUBLICATIONS

International Search Report issued in corresponding International Patent Application No. PCT/AU2016/050380 dated Jul. 11, 2016 (3 pages).

*Primary Examiner* — Abigail A Risic
(74) *Attorney, Agent, or Firm* — Kilyk & Bowersox, P.L.L.C.

(57) ABSTRACT

A paver mountable to a vehicle to provide propulsion and hydraulic power to the paver, wherein the paver includes: a drive system coupling for mounting the vehicle to the paver; hydraulic mounts to connect with hydraulic power from the vehicle; a solids handling assembly for receiving paving material and for delivering paving material to a paving site; a screed assembly with a screed plate which is hydraulically adjustable in extension, height and grade; wherein, paving material delivered to the paving site is shaped by the screed assembly as the paver is propelled forward to produce a paved surface.

18 Claims, 16 Drawing Sheets

(56) References Cited

U.S. PATENT DOCUMENTS

| | | | | | |
|---|---|---|---|---|---|
| 3,557,672 | A | * | 1/1971 | Shurtz | E01C 19/4873 404/118 |
| 3,992,124 | A | * | 11/1976 | Schrader | E01C 19/4833 404/118 |
| 4,194,854 | A | * | 3/1980 | Mauldin | B62D 59/02 280/503 |
| 5,308,190 | A | | 5/1994 | Raymond | |
| 5,924,819 | A | * | 7/1999 | Breidenbach | E01C 19/42 404/104 |
| 8,221,025 | B2 | * | 7/2012 | Buschmann | E01C 19/48 404/75 |
| 8,403,594 | B2 | | 3/2013 | Neumann | |
| 2007/0201952 | A1 | | 8/2007 | Neumann | |
| 2011/0305551 | A1 | | 12/2011 | Neumann | |
| 2012/0282026 | A1 | | 11/2012 | Atherton | |

* cited by examiner

PAVER

This application is a National Stage Application of PCT/AU2016/050380, filed May 19, 2016, which claims priority to Australian Patent Application No. 2015901814, filed May 19, 2015, Australian Patent Application No. 2015903690, filed Sep. 10, 2015, and Australian Patent Application No. 2016901643, filed May 4, 2016.

TECHNICAL FIELD

The present invention generally relates to a paver.

BACKGROUND

Pavers are known to the art as a means to form a paved surface such as a road base or asphalt which and are generally used to produce roads. Typical pavers incorporate a drive system as well as a paving system in a single piece of plant. Such pavers are generally configured to lay a fixed width of paved surface, which is usually large in size to produce a road with a minimum number of passes of the paver.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

BRIEF SUMMARY

According to a first aspect, the present invention provides a paver mountable to a vehicle to provide propulsion and hydraulic power to the paver, wherein the paver includes: a drive system coupling for mounting the vehicle to the paver; hydraulic mounts to connect with hydraulic power from the vehicle; a solids handling assembly for receiving paving material and for delivering paving material to a paving site; a screed assembly with a screed plate which is hydraulically adjustable in extension, height and grade; wherein, paving material delivered to the paving site is shaped by the screed assembly as the paver is propelled forward to produce a paved surface.

According to a further aspect, the present invention provides a paver according to the first aspect wherein, the vehicle is a skid steer vehicle.

According to a further aspect, the present invention provides a paver according to the first aspect wherein, the paver includes a mounting bracket operatively connected to the screed assembly, wherein the mounting bracket is pivotably attached to the solids handling assembly, and wherein the mounting bracket may be tilted about the pivotable attachment to adjust the grade of the screed assembly According to a further aspect, the present invention provides a paver according to the first aspect wherein, a first hydraulic ram acts on the mounting bracket to tilt the mounting bracket, and wherein the first hydraulic ram is powered by the hydraulic power of the vehicle.

According to a further aspect, the present invention provides a paver according to the first aspect including a screed mount operatively connected to the mounting bracket and to the screed assembly, wherein the screed mount includes one or more first collars in sliding attachment with one or more first guide rails, said first guide rails being rigidly attached to the mounting bracket such that the screed mount may be adjusted in position along the first guide rails to adjust the height of the screed assembly According to a further aspect, the present invention provides a paver according to the first aspect wherein, a second hydraulic ram acts on the screed mount to adjust the position of the screed mount along the first guide rails, and wherein the second hydraulic ram is powered by the hydraulic power of the vehicle.

According to a further aspect, the present invention provides a paver according to the first aspect wherein, wherein the mounting bracket includes one or more second set of collars in sliding attachment with one or more second guide rails, said second guide rails being rigidly attached to the screed assembly such that the position of the screed assembly may be adjusted relative to the screed mount by sliding the second guide rails through the second collars to adjust the extension of the screed assembly.

According to a further aspect, the present invention provides a paver according to the first aspect wherein, a third hydraulic ram acts between the screed assembly and the screed mount to adjust the position of the screed assembly relative to the screed mount, and wherein the third hydraulic ram is powered by the hydraulic power of the vehicle.

According to a further aspect, the present invention provides a paver according to the first aspect wherein, the solids handling assembly includes a hopper for receiving paving material from a tipping truck; a conveyor fed by the hopper; one or more rollers for contacting with the tyres of a tipping truck when the tipping truck is in position for loading paving material to the hopper.

According to a further aspect, the present invention provides a paver according to the first aspect wherein, the hopper and conveyor are sized to accommodate the full span of the tipper truck.

According to a further aspect, the present invention provides a paver according to the first aspect wherein, when the tipper truck is in position against the one or more rollers, the tipper truck can be propelled in unison with the paver by a force applied by the paver which is in turn propelled by the vehicle.

According to a further aspect, the present invention provides a paver according to the first aspect wherein, the screed plate has a generally U-shaped profile and an internal cavity.

According to a further aspect, the present invention provides a paver according to the first aspect wherein, hot gases are passed through the internal cavity to heat the screed plate.

According to a further aspect, the present invention provides a paver according to the first aspect wherein, the hot gasses are produced by combusting LPG in a combustor within the cavity.

According to a further aspect, the present invention provides a paver according to the first aspect including an auger assembly arranged adjacent to a portion of the screed plate, where rotation of the auger assembly is configured to transport paving material in the paving site to a portion of the paving site distal to the solids handling assembly.

According to a further aspect, the present invention provides a paver according to the first aspect wherein, the screed assembly may be configured with a longitudinal axis at an angle to a longitudinal axis of the solids handling assembly.

According to a second aspect, the present invention provides a paver mountable to a vehicle to provide propulsion and hydraulic power to the paver, wherein the paver includes: a drive system coupling for mounting the vehicle to the paver; hydraulic mounts to connect with hydraulic power from the vehicle; a solids handling assembly for receiving paving material and for delivering paving material to a paving site; a screed assembly with a screed plate which is hydraulically adjustable in extension from the solids handling assembly; wherein, paving material delivered to the paving site is shaped by the screed assembly as the paver is propelled forward to produce a paved surface, and wherein the paver includes a screed mount fixedly attached to the solids handling assembly and configured with one or more collars in sliding attachment with one or more guide rails fixedly attached to the screed assembly such that the extension of the screed assembly relative to the solids handling assembly may be adjusted by sliding the guide rails through the collars.

According to a further aspect, the present invention provides a paver according to the first or second aspects wherein, a vehicle is coupled to the drive system coupling and to the hydraulic mounts, wherein the tipper truck is positioned against the paver such that the rear tyres of the tipper are in contact with the one or more rollers such that as the vehicle propels the paver forward the one or more rollers push against the tyres of the tipper truck thus moving the tipper truck in unison with the paver and vehicle, the method comprising the steps of operating the tray of the tipper truck to supply the hopper with paving material; transferring the paving material from the hopper to the paving site by the conveyor; shaping of the paving material by the screed plate as the paver is propelled forward.

PREFERRED EMBODIMENTS

Figure 1:
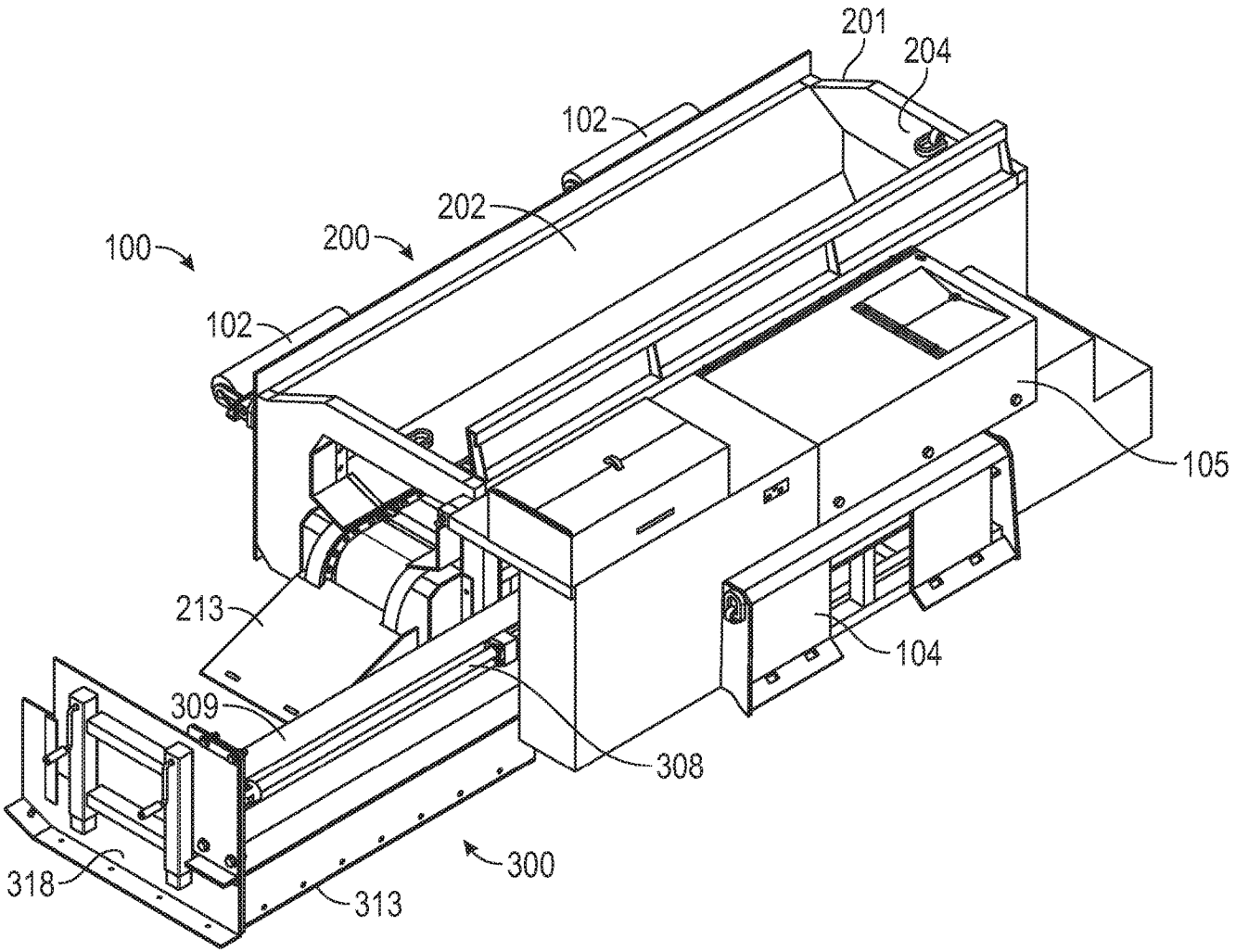
FIG. 1 shows a perspective view of a paver.

The following modes, given by way of example only, are described in order to provide a more precise understanding of the subject matter of a preferred embodiment or embodiments.

In the figures, incorporated to illustrate features of an example embodiment, like reference numerals are used to identify like parts throughout the figures.

Described are embodiments of a paver 100 for paving a road with a paving material such as asphalt, gravel or cement. The paver 100 may be mountable to a vehicle including an independent variable speed hydraulic drive system such as a skid steer loader, back-hoe or loader, which propels the paver. The paver 100 may also be hydraulically coupled to the skid steer vehicle to provide hydraulic power for the operation of the paver. The paver includes a hopper 201 configured to receive paving material from a tipper truck. The hopper 201 in turn feeds a conveyor 205 that delivers the paving material to the site to be paved. An adjustable screed assembly 300 extends from behind the hopper 201 in the same general longitudinal direction as the hopper such that material discharged from the conveyor 205 is trailed by the screed assembly 300. As the skid steer loader propels the paver 100 forward, the conveyor 205 may continually discharge paving material along the site to be paved. The screed assembly 300 trails the discharge site of the paving material such that as the paver 100 advances the screed molds the paving material to form a paved surface such as an asphalt mat.

Referring to the figures, shown is an embodiment of the present invention suitable for paving a road shoulder with asphalt, though it is to be understood that the invention is equally suited for the laying of several paving materials or construction materials. For example, the paver may be used to lay gravel, road base or sands. The paver 100 is generally formed from a chassis 101 of tubular steel providing for a strong and rigid structure. The paver 100 may include two main components, a solids handling assembly 200 to receive paving material and deliver paving material to a site to be paved, and a screed assembly 300 to shape the paving material into a mat such as a road shoulder.

The solids handling assembly 200 includes an elongate hopper 201 for receiving asphalt. The hopper 201 may be sized to span the width of a tipper truck tray used to deliver asphalt to the hopper 201 such that substantially all material discharged from a tipper truck tray may be captured by the hopper 201. At least a portion of the front wall 202 of the hopper 201 may be arranged on an angle with respect to the vertical, thereby encouraging asphalt being delivered by the tipper truck towards the bottom of the hopper 201. The rear 203 and side 204 walls of the hopper may be vertical and have a greater height than the front wall to accommodate the asphalt and to prevent spillage of asphalt from these walls. In certain embodiments such as that depicted in the figures, at least a portion of the rear 203 or side 204 walls may also be arranged on an angle with respect to the vertical to encourage asphalt toward the conveyor and/or to avoid dead spots at the bottom of the conveyor 205 that may cause build up of asphalt. An external portion of the front wall 202 may be configured with rollers 102, which are adapted to contact with the rear tyres of a tipper truck when the tipper truck is in position to deliver asphalt to the hopper 201. The distance of the rollers from the front wall 202 may be adjustable which may allow the paver 100 to be used with tipper trucks of varying dimension.

Figure 2:
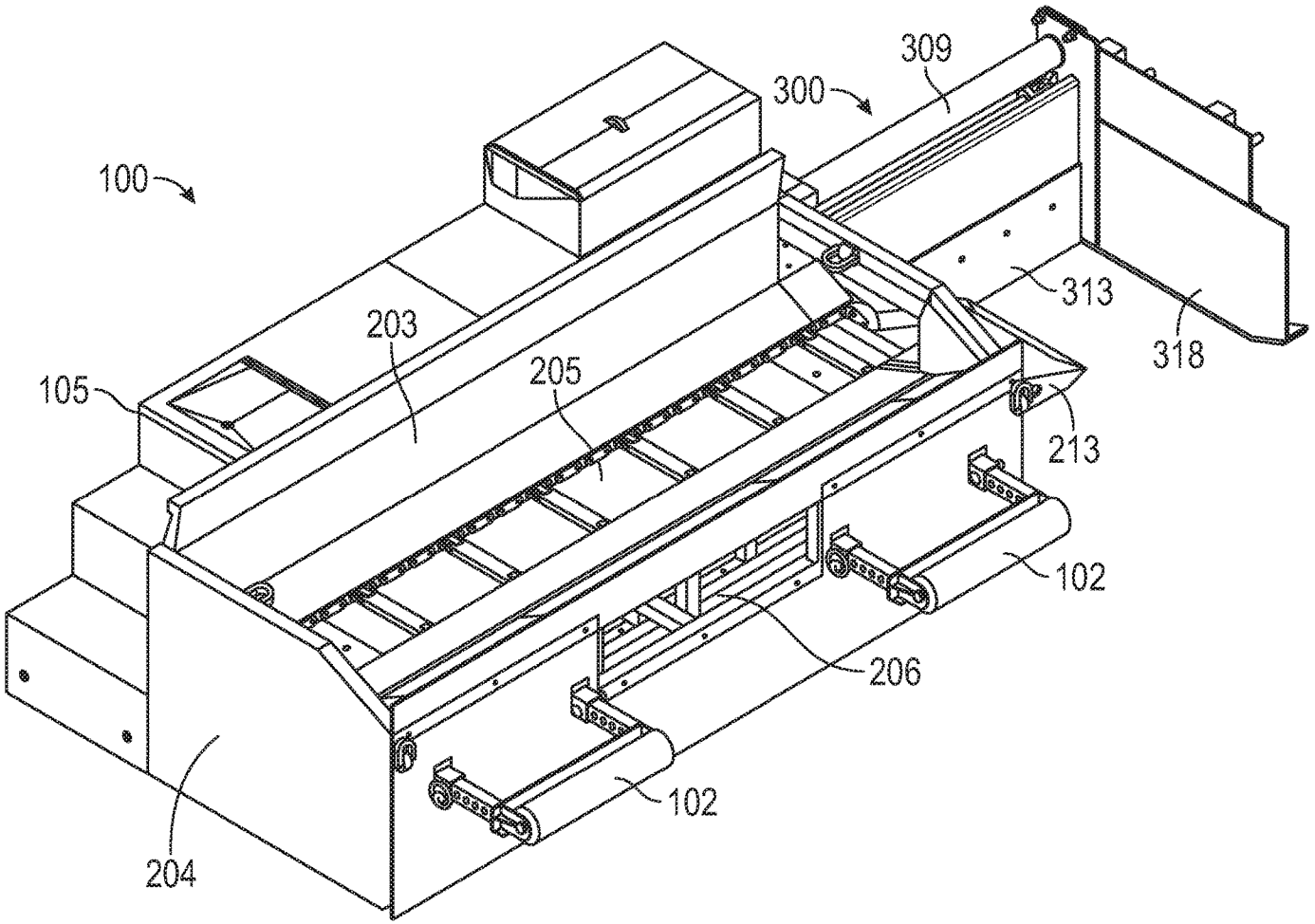
FIG. 2 shows an alternative perspective view of a paver.
Figure 3:
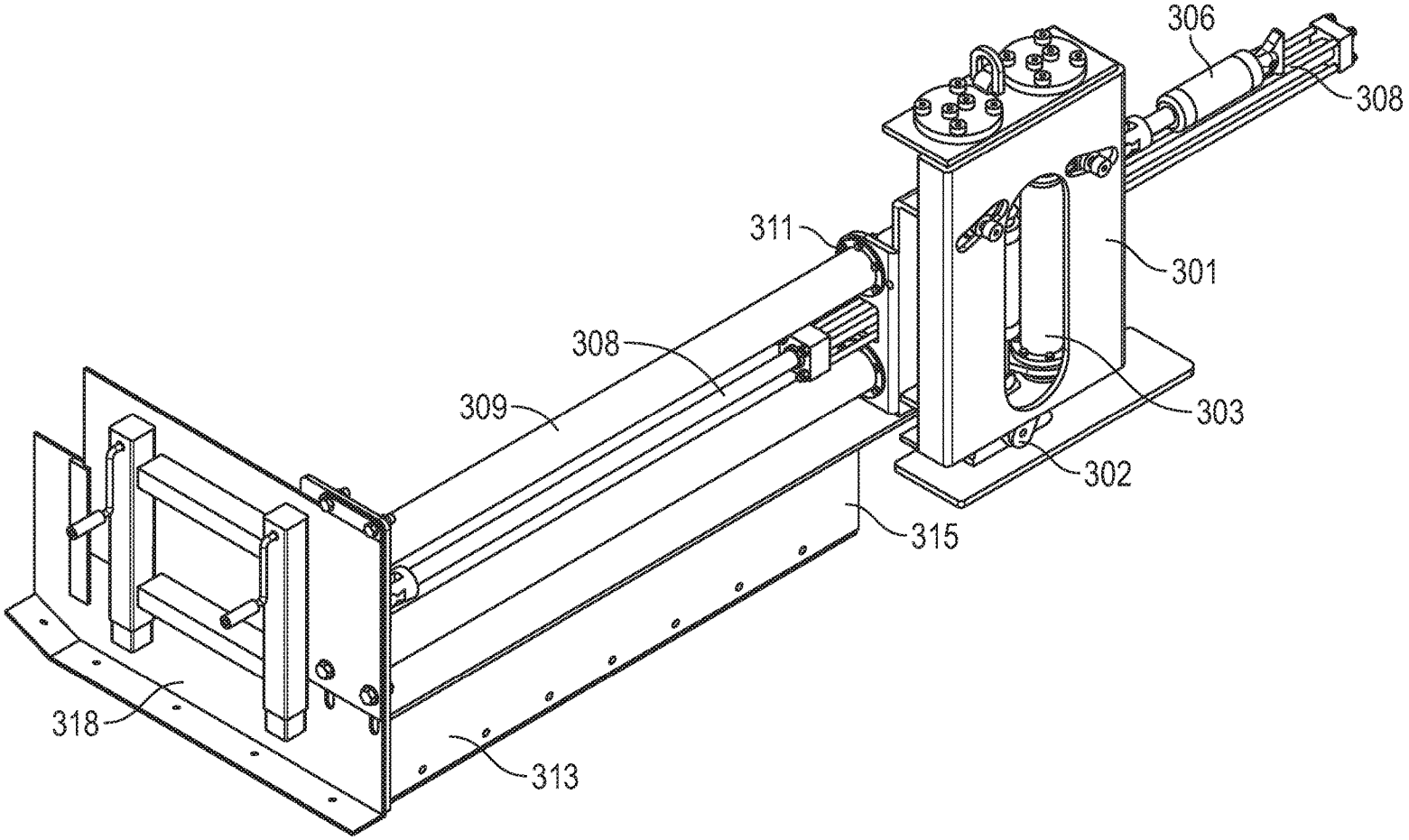
FIG. 3 shows a perspective view of a screed assembly and attached equipment.
Figure 4:
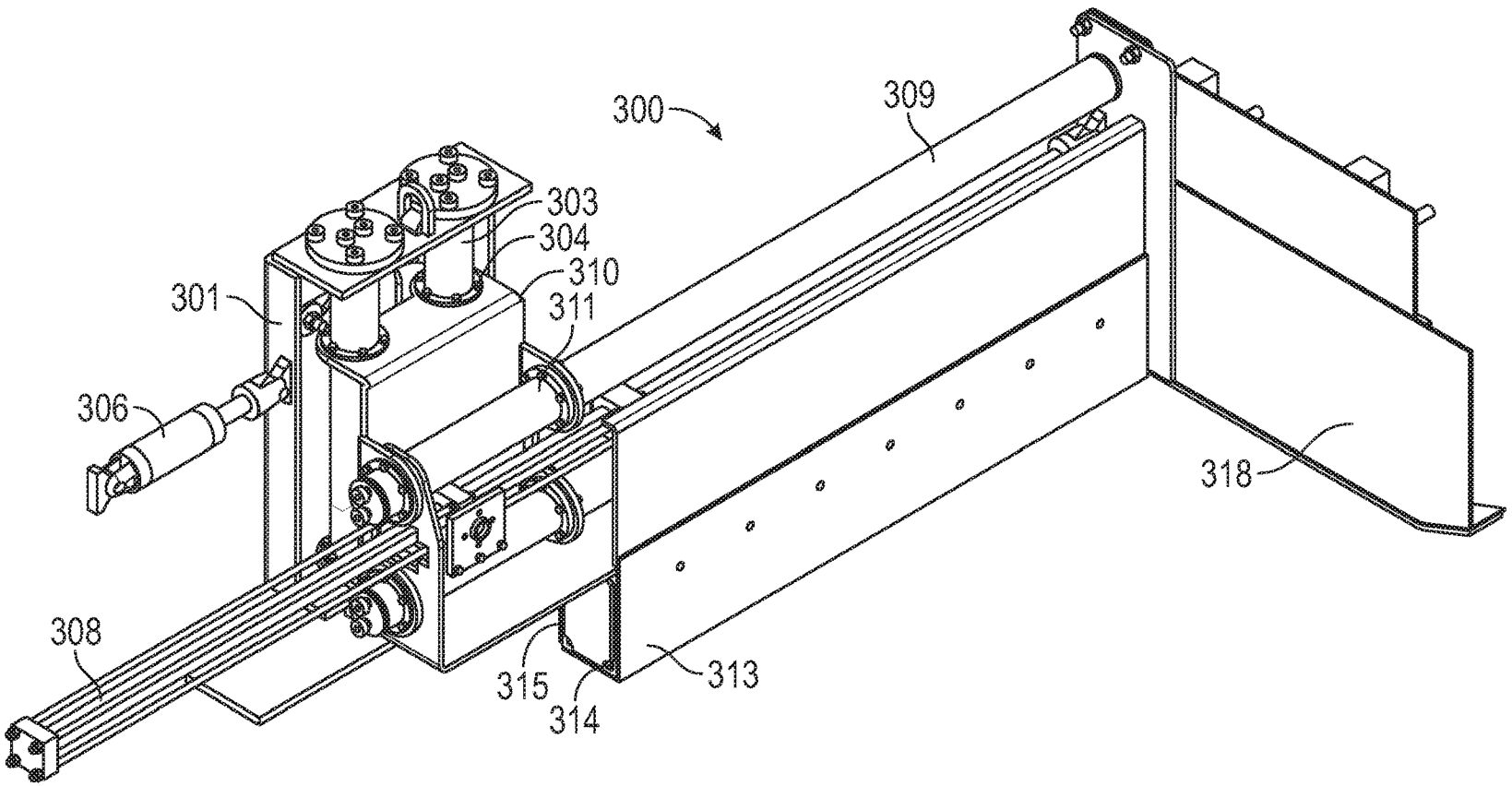
FIG. 4 shows an alternative perspective view of a screed assembly and attached equipment.
Figure 5:
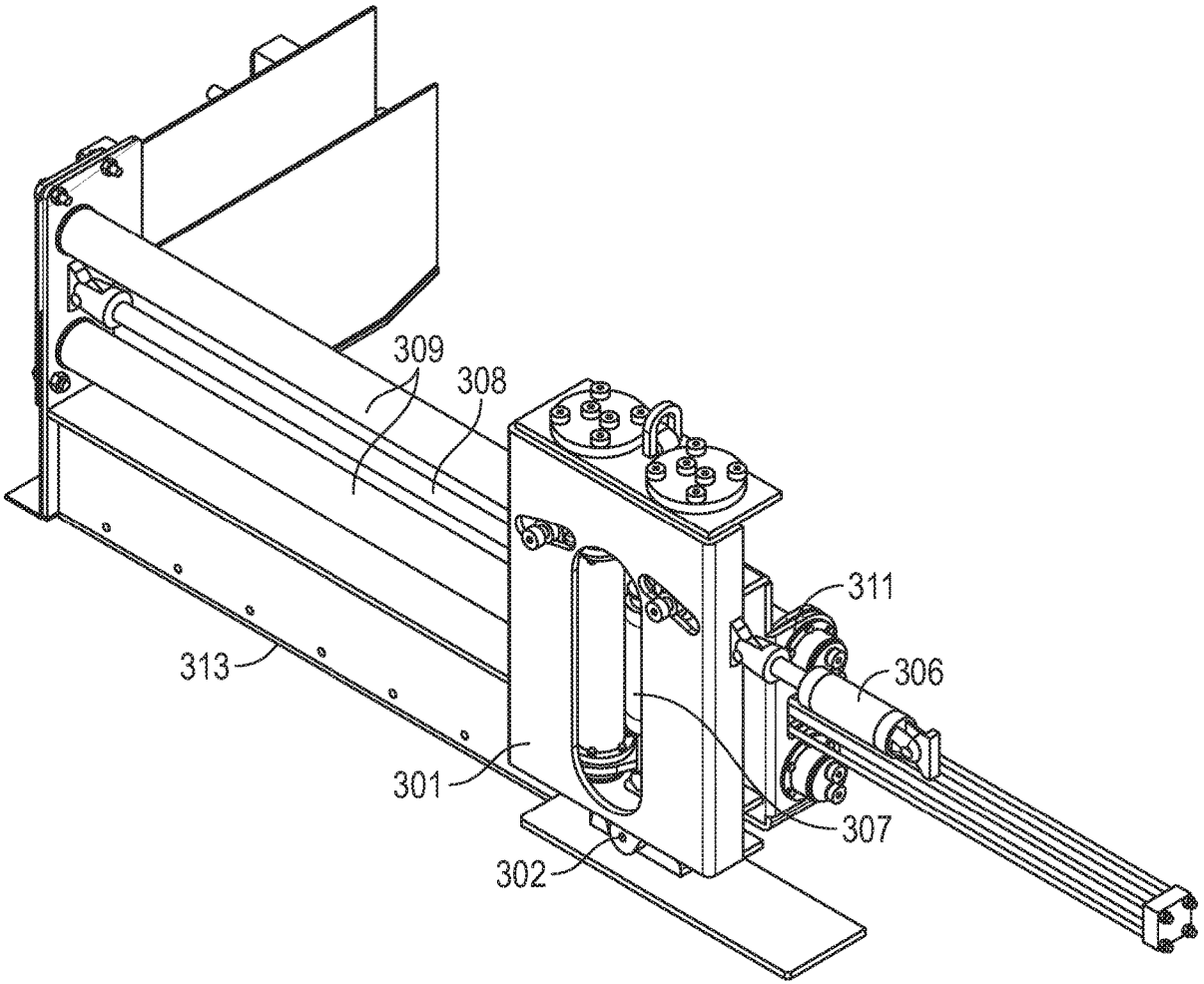
FIG. 5 shows an alternative perspective view of a screed assembly and attached equipment.
Figure 6:
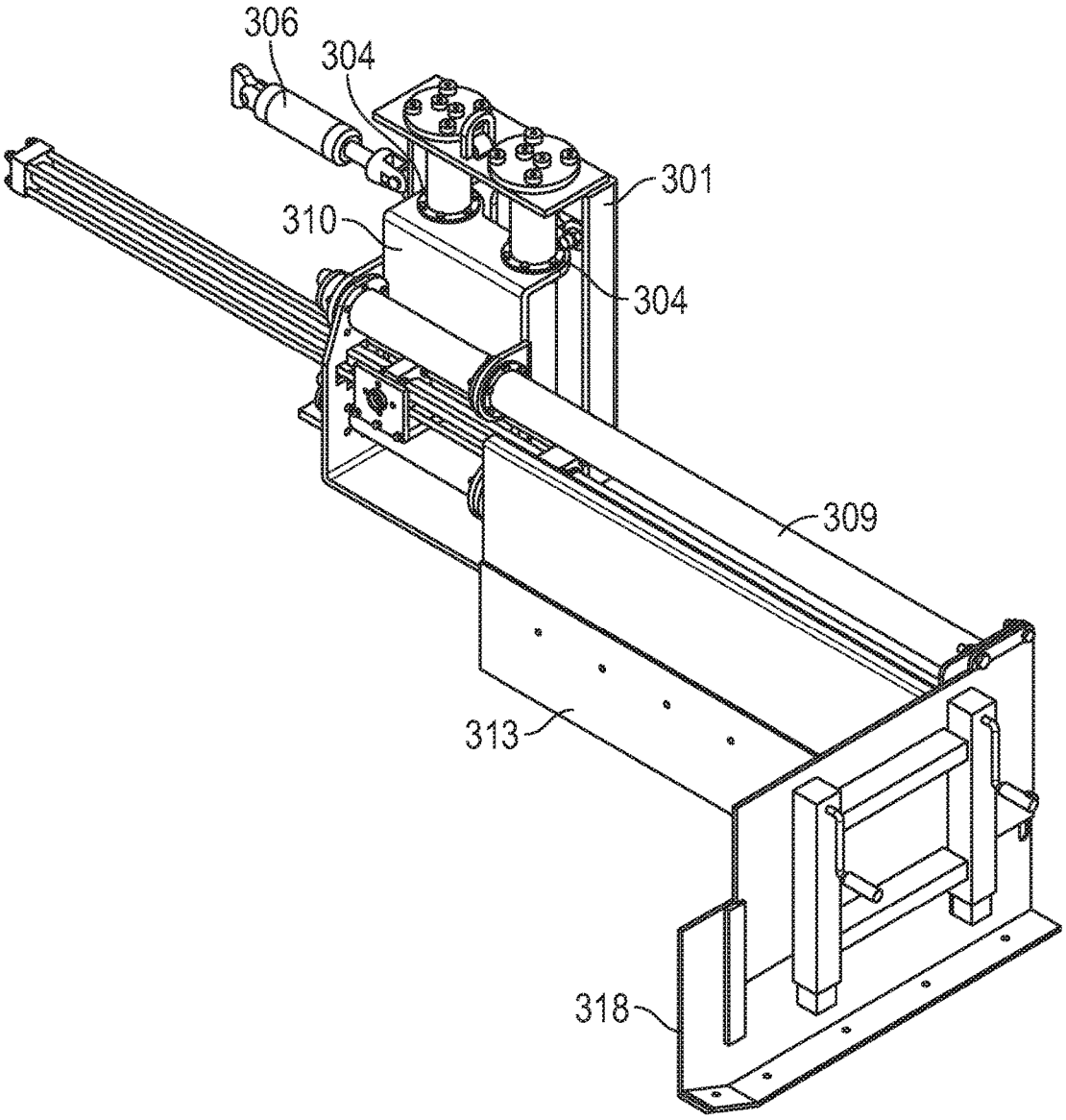
FIG. 6 shows an alternative perspective view of a screed assembly and attached equipment.
Figure 7:
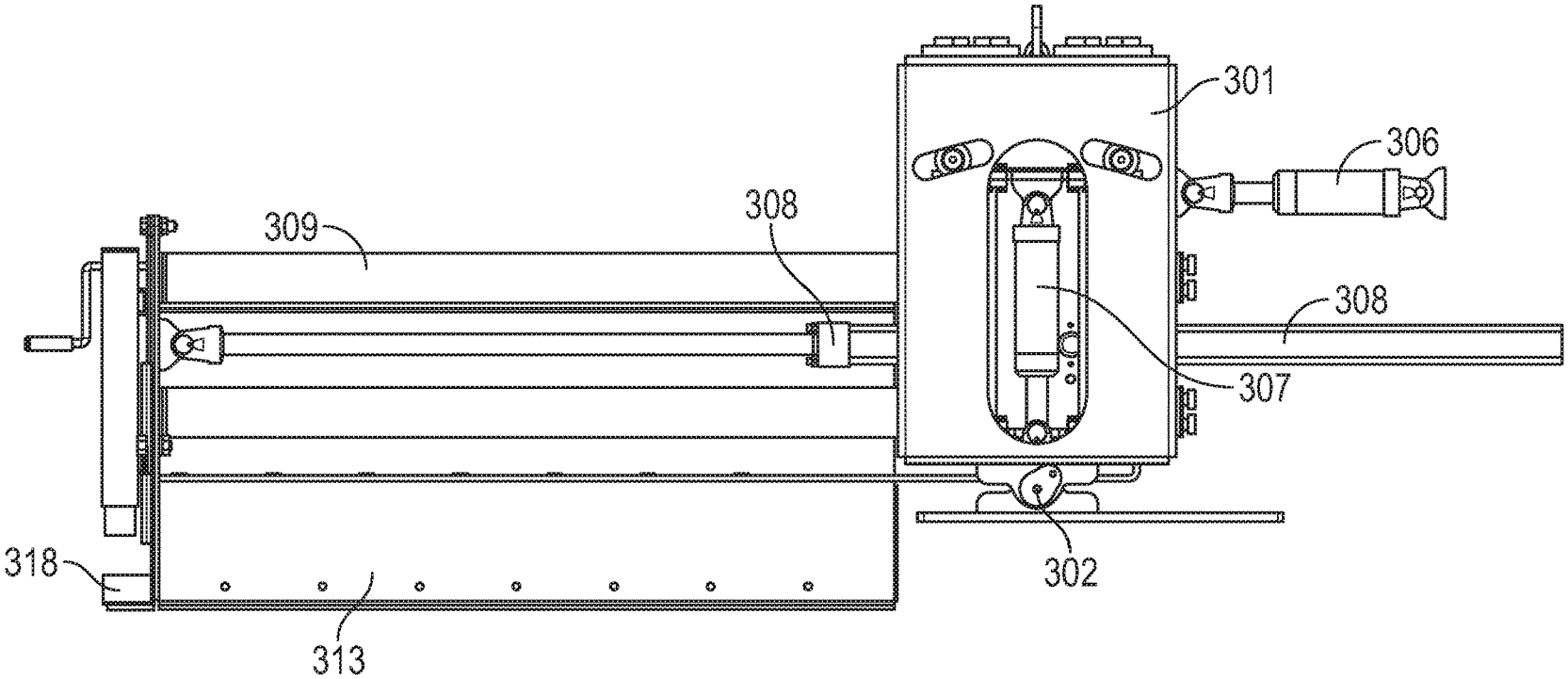
FIG. 7 shows a front view of a screed assembly and attached equipment.
Figure 8:
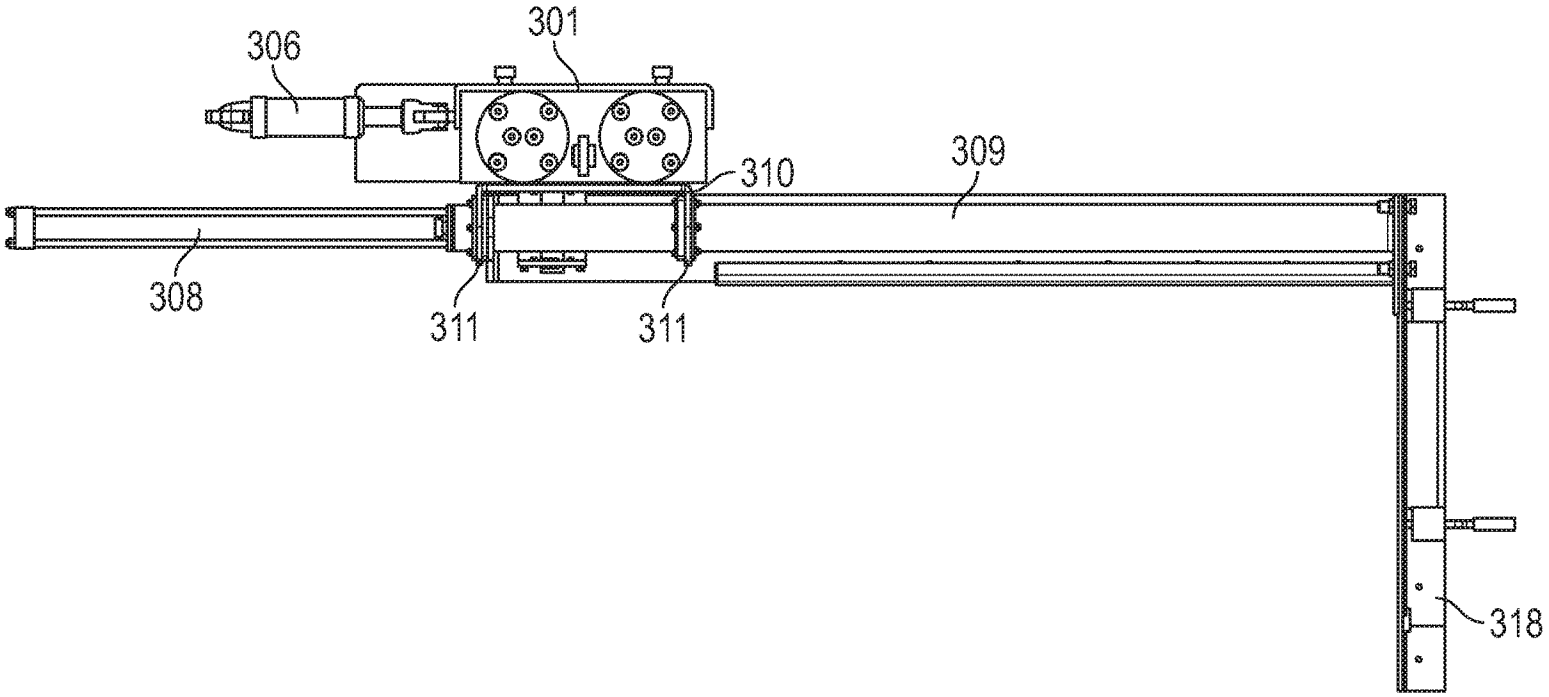
FIG. 8 shows a top view of a screed assembly and attached equipment.
Figure 9:
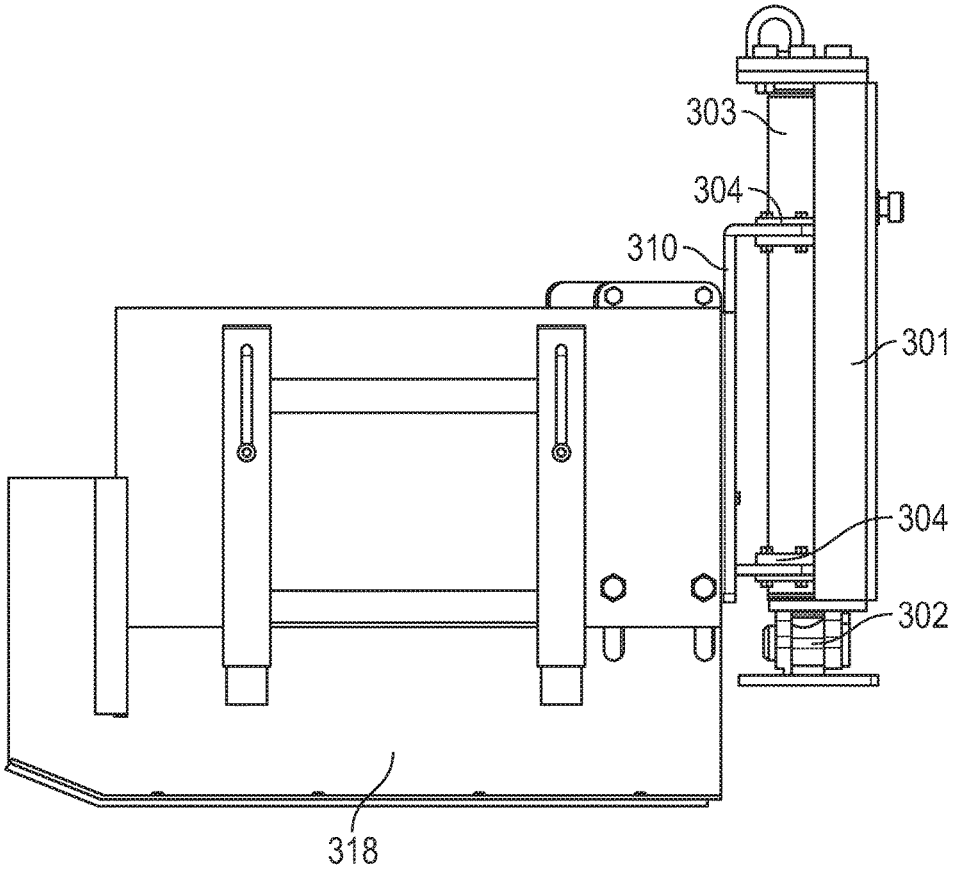
FIG. 9 shows a side view of a screed assembly and attached equipment.
Figure 10:
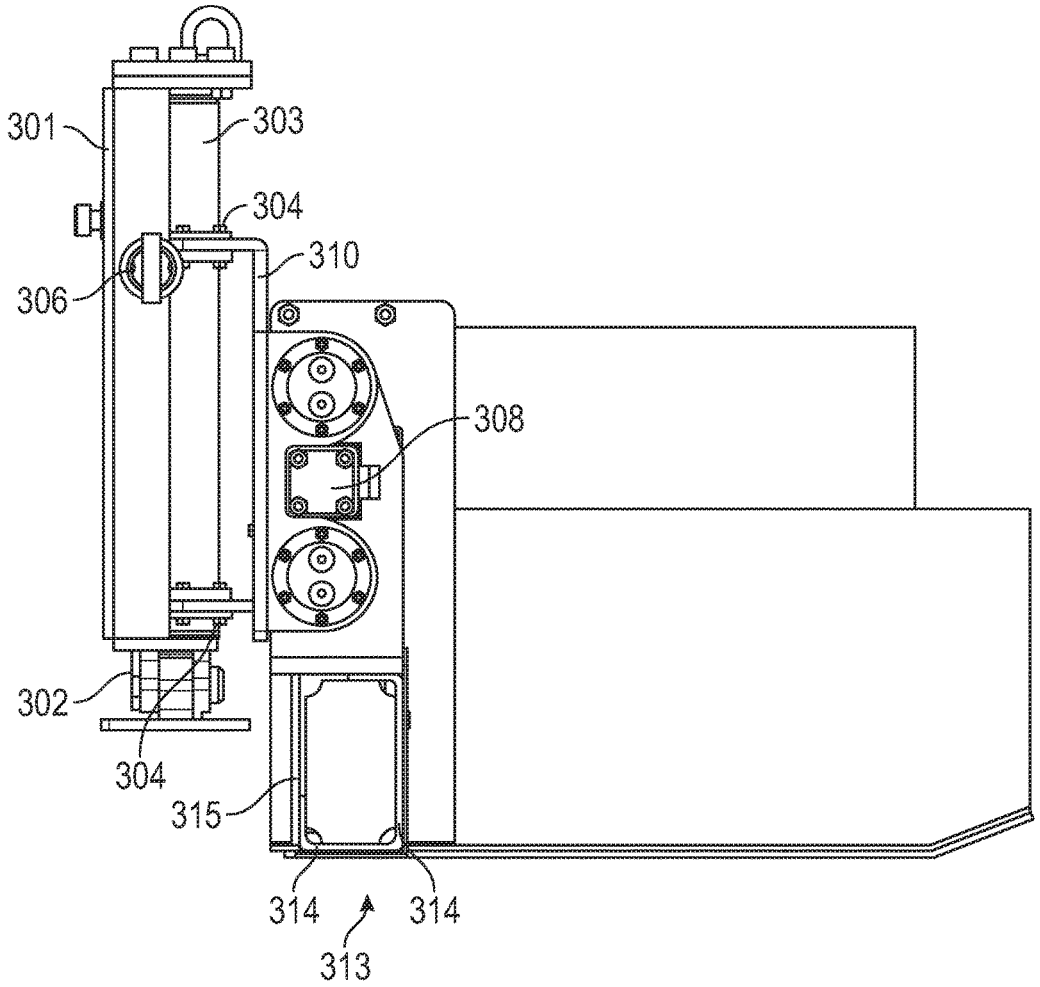
FIG. 10 shows a side view of a screed assembly and attached equipment.
Figure 11:
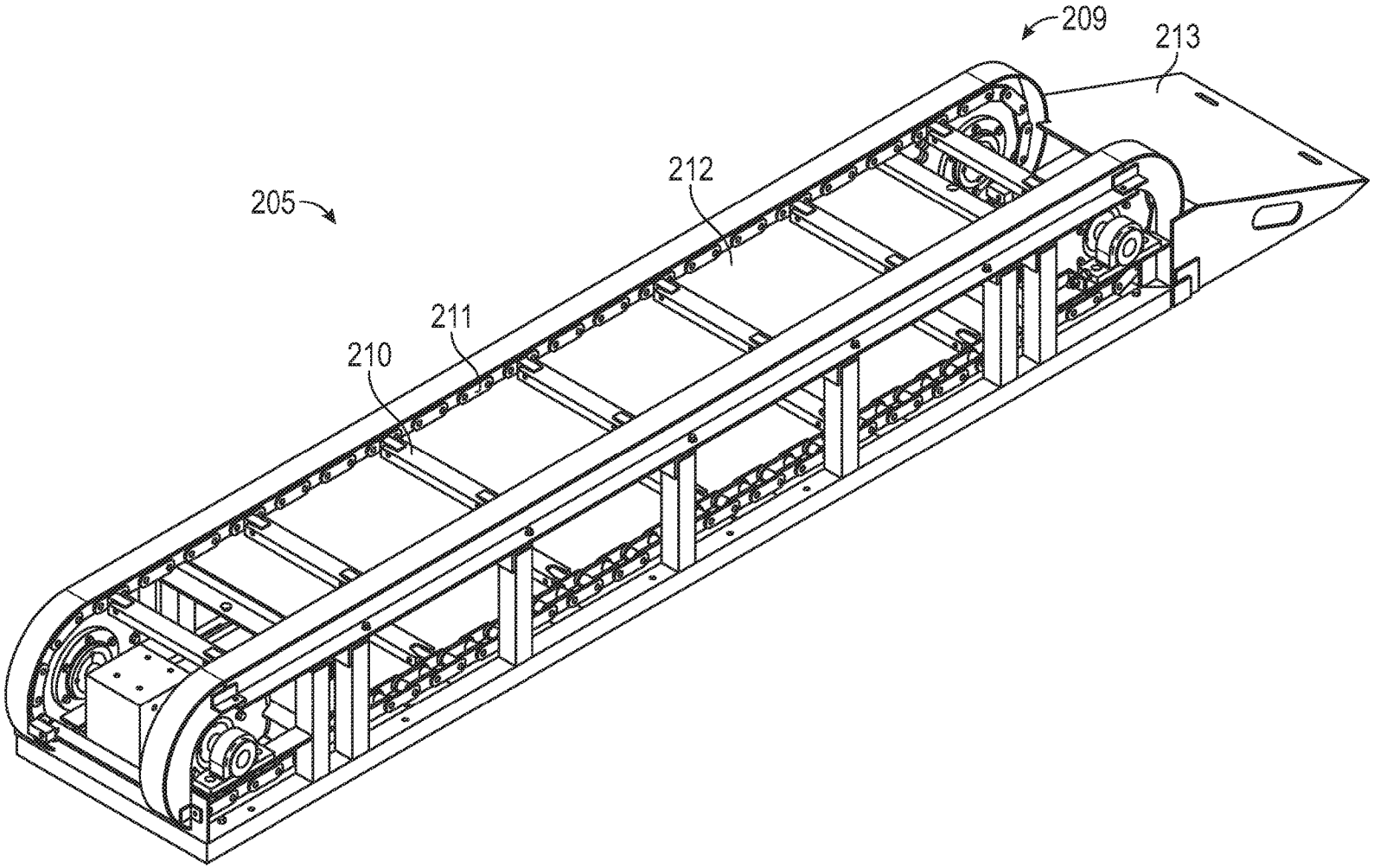
FIG. 11 shows a perspective view of a conveyor.
Figure 12:
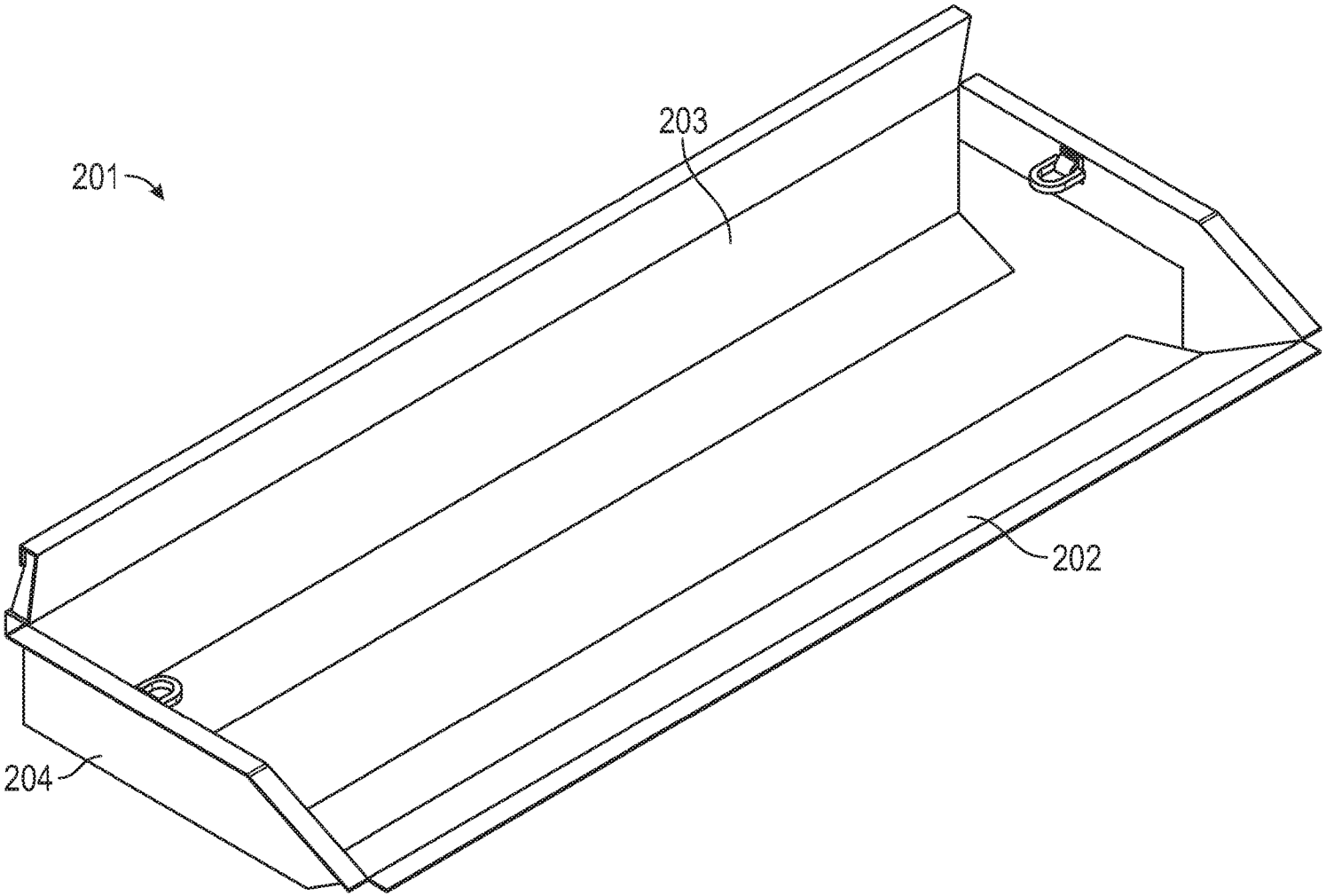
FIG. 12 shows a perspective view of a hopper.
Figure 13:
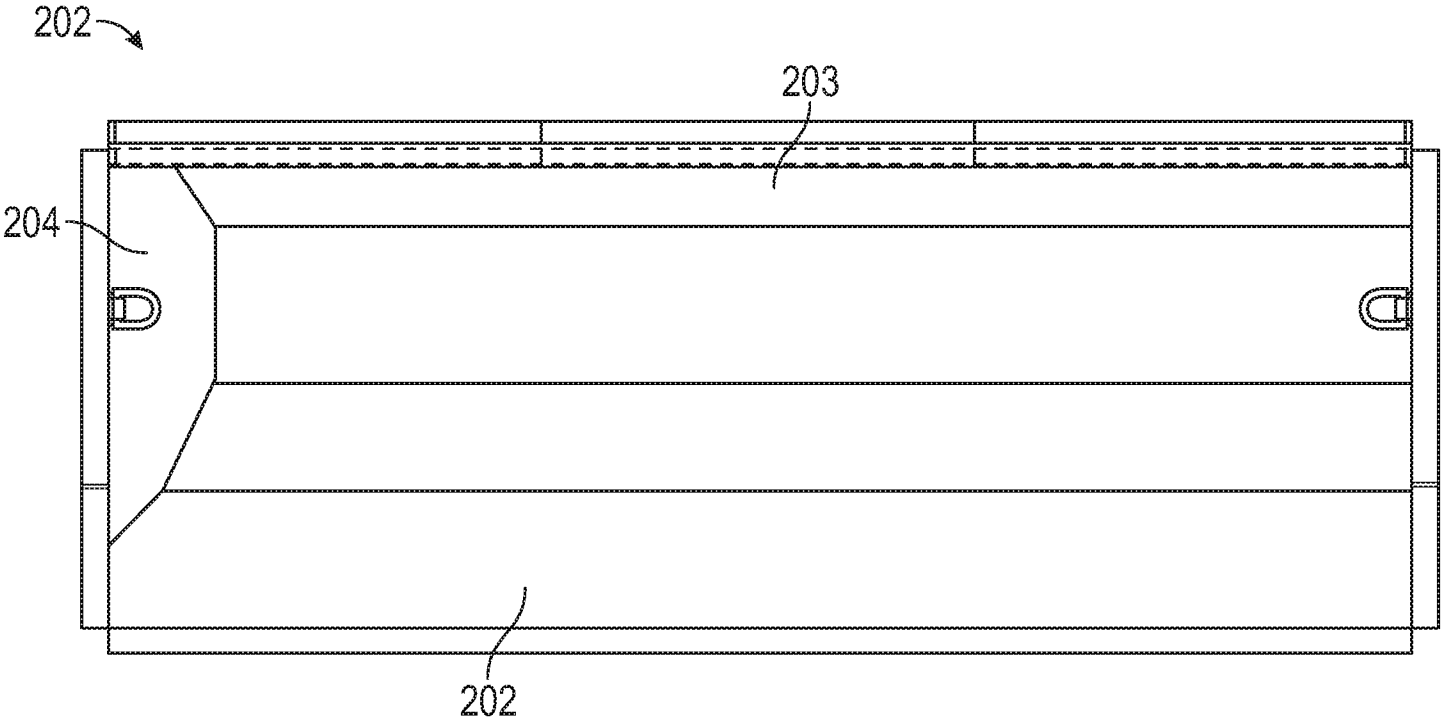
FIG. 13 shows a top view of a hopper.
Figure 14:
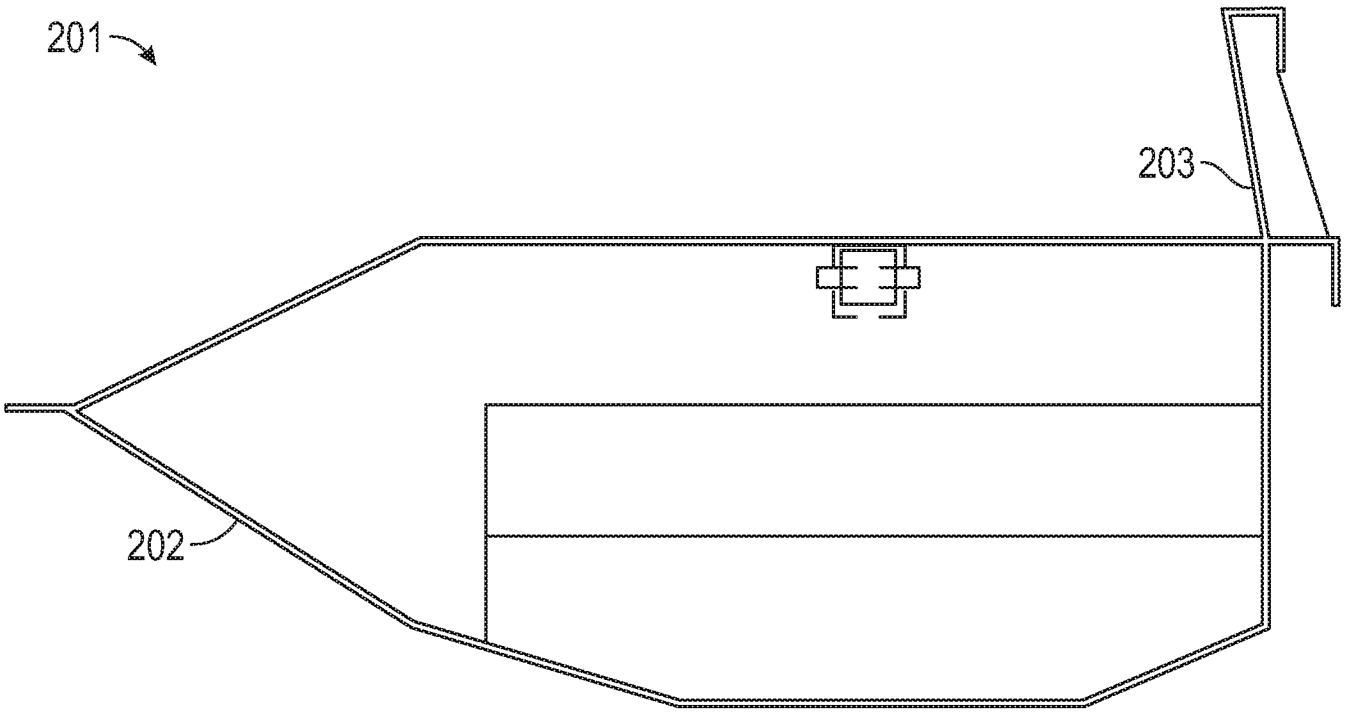
FIG. 14 shows a side view of a hopper.
Figure 15:
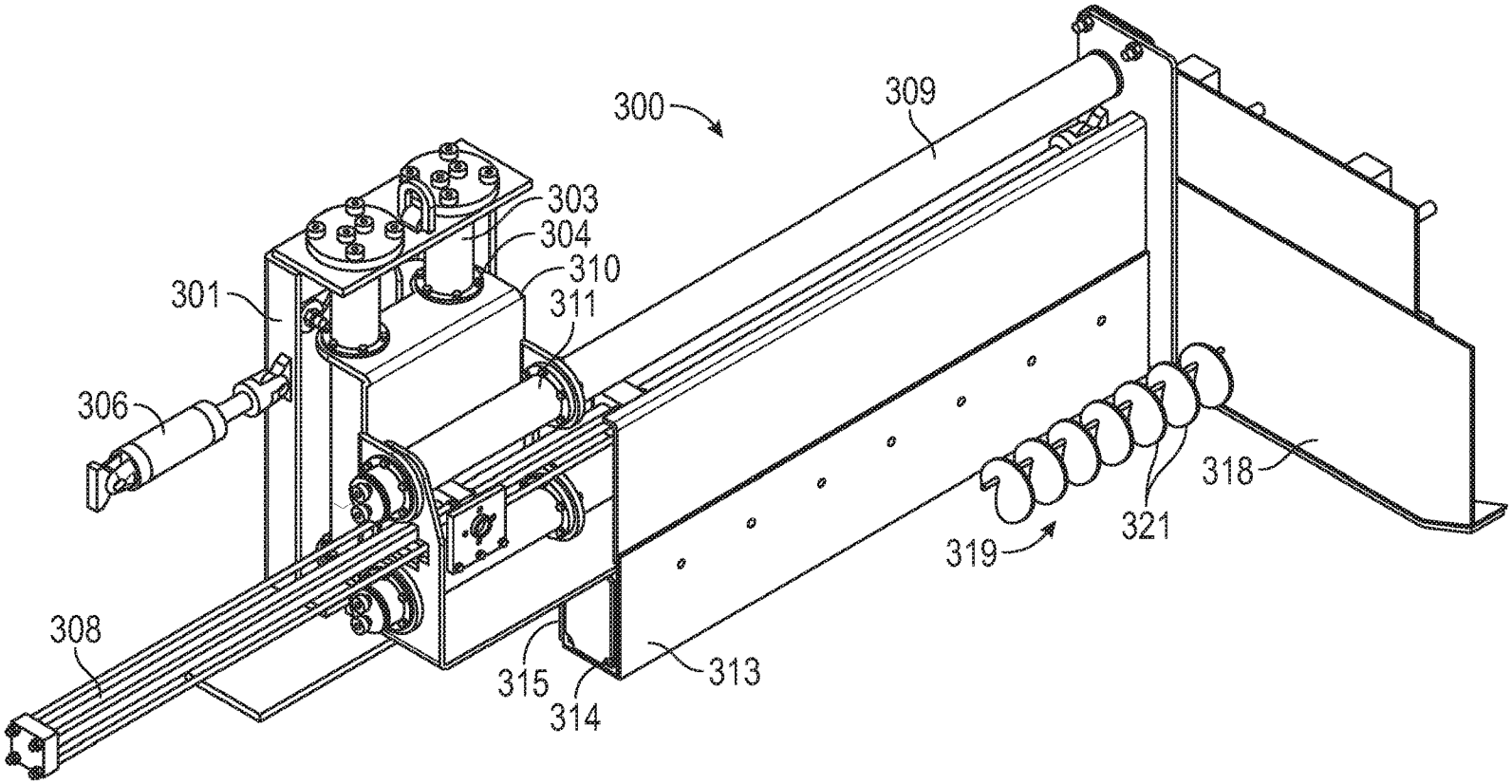
FIG. 15 shows a perspective view of a screed assembly showing the position of an auger arrangement according to an embodiment.
Figure 16:
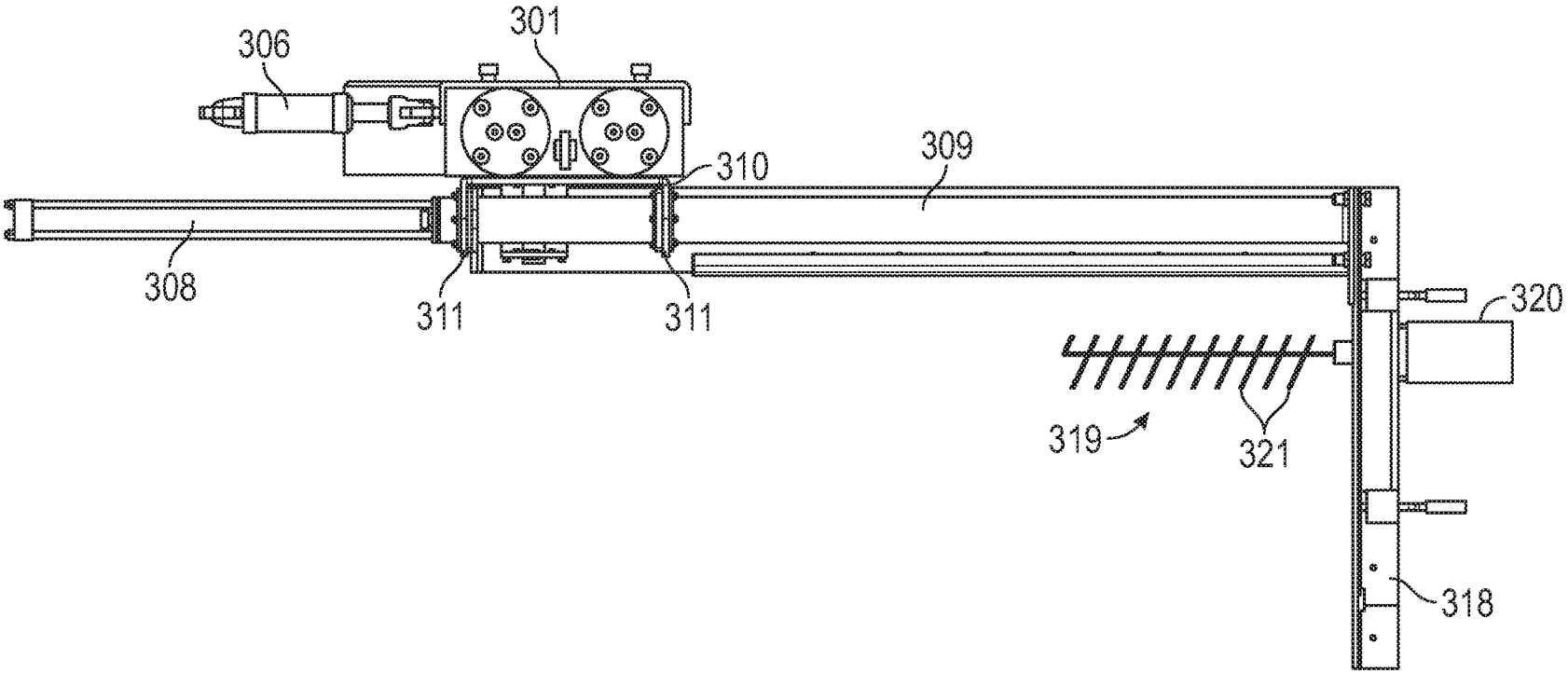
FIG. 16 shows a top view of a screed assembly showing the position of an auger arrangement according to an embodiment.

In some circumstances, the rear of a tipper truck may have a protuberance such as a tow-hitch, Bartlett ball or ring feeder that may prevent the tipper truck from properly positioning with respect to the paver such that some paving material may not fall inside in the hopper 201 causing spillage. To account for this, the front of the paver 100 may be configured with a cavity 206 to accommodate such a protuberance and to allow for close positioning between the tipper truck and the hopper 201. The cavity 206 may be located between the rollers 102 at depicted in FIG. 2. In some embodiments, a portion of the front wall 202 of the hopper above the cavity 206 may be hinged so that it may be lifted upwardly to increase the height of the cavity 206. This arrangement may be useful to provide an adjustable cavity 206 that may accommodate protuberances on various models of tipper truck. Side plates depending downwardly from the edges of the hinged portion of the front wall of the hopper 201 may be used to avoid gaps in the front wall of the hopper when the hinged portion is lifted in order to prevent spillage of paving material from the hopper.

Running along the length of the bottom of the hopper 201 is a conveyor 205 configured to convey asphalt to a paving site. The conveyor may span 205 substantially the whole length of the hopper 201, thus also substantially spanning the whole width of the tipper truck tray discharging asphalt to the hopper 201. This configuration may help ensure that substantially all material being discharged by the tipper truck and collected by the hopper 201 is incident on a portion of the conveyor 205, and that dead spots in the hopper 201 are avoided that may cause build up and overflow of asphalt.

The conveyor 205 may be of a direct driven modular hydraulically operated steel track design. A suitable motor for such a conveyor 205 may be a Hint MSYA400CU or a motor similar in specification thereto and a suitable gear box may be a Berma RT100 or a gear box similar in specification thereto. The conveyor may be configured with tracks 210 arranged at intervals between the conveyor chain 211 that may be configured to pass over a stationary wear plate 212 at the bottom of the hopper 201. The movement of the tracks 210 over the wear plate 212 will drag a portion of the asphalt in the hopper 201 along the length of the conveyor 205 towards the discharge end 209 of the conveyor 205 for placement at the paving site. The discharge end 209 of the conveyor 205 may be configured with a discharge chute 213 which may facilitate the even placement of asphalt at the paving site. The wear plate 212 may be replaced as necessary due to wear. As the conveyor is modular, the entire conveyor 205 may be removed from the paver 100 as a unit for replacement or repair.

The hydraulic power required by the conveyor 205 may be provided by the skid steer vehicle which is mounted to the paver 100. The track conveyor 205 may offer certain advantages over other solids handling equipment such as screw augers, including advantages in material throughput, robustness and reliability. These advantages may make the conveyor 205 ideal for handling hot asphalt, though the robustness of the conveyor is suitable for a variety of paving materials such as sand, cement, dense graded base course or dense graded sub base. In alternative embodiments, a belt conveyor may be used, which in addition to handling asphalt, may also be suitable for granular paving materials. In a versatile embodiment, conveyor belt matting may be arranged around a track conveyor 205 and fixed to the tracks 210 to form a belted conveyor. Attaching the conveyor belt matting to the tracks 210 of the track conveyor may help minimize stretching and slipping of the belt, which may in turn lead to less requirements for tightening and other maintenance. The conveyor belt matting may be removed from the tracks 206 to revert the conveyor back to a track style conveyor if desired.

Asphalt handled by the conveyor 205 is discharged at the discharge end 209 of the conveyor. When in use, the paver 100 is orientated such that the discharge end 209 will place the asphalt at the site requiring paving. It is usually the case that the paving site is a long strip, such as the road shoulder adjacent to a road. Accordingly, as the paver 100 is advanced, the conveyor 205 will continuously discharge asphalt to the paving site in anticipation of being molded and shaped into a asphalt mat by the screed assembly 300 to cover the road shoulder.

As the solids handling assembly 200 is generally elongate in order to accommodate the width of a tipper truck, the discharge end 209 of the conveyor 205 is located beside the skid steer such that as the skid steer advances, paving material will be discharged by the conveyor 205 at an area beside the skid steer at a distance spaced by the length of the conveyor 205 and the discharge chute 213. This arrangement is advantageous for paving a road shoulder as the skid steer can drive along an already paved road and discharge material to a site alongside that road which can be shaped to form a road shoulder. Due to the relatively compact nature of the paver 100, laying a road shoulder may only require closure of a single lane or possibly still allow two way traffic via the use of a previously extended shoulder and under delineation via lateral shifting of the traffic.

The speed at which the conveyor is run may increase the distance from the chute 213 at which the paving material is placed in the paving site and may help facilitate the paving of wider mats in some embodiments.

A screed assembly 300 is fixed to a rear periphery of the chassis 101 of the solids handling assembly 200. A mounting bracket 301 facilitates attachment of the screed assembly 300 to the solids handling assembly 200. The mounting bracket 301 is attached to a portion of the chassis 101 of the solids handling assembly 200 by a pivot 302 at the base of the bracket 301 which may take the form of a pin. The pivot 302 allows the bracket 301 to tilt with respect to the solids handling assembly 200.

The screed assembly 300 is attached to the mounting bracket 301 by a screed mount 310 as described below. Therefore, pivoting the mounting bracket 301 about the pivot 302 tilts the screed assembly 300 with respect to the horizontal which sets the grade of the screed assembly 300. The force required to pivot the mounting bracket 301 may be provided by a hydraulic ram termed the grade ram 306. One end of the grade ram 306 may be attached to a portion of the mounting bracket 301 that may be distal from the pin 302. The other end may be attached to a rigid portion of the solids handling assembly 200 such as the chassis 101, such that the lineal movement of the grade ram 306 will pivot the mounting bracket 301 about the pivot 302. By this arrangement, the grade ram 306 controls the grade of the screed assembly 300. In the embodiment of the figures, the linear movement of the grade ram 306 occurs in a horizontal or substantially horizontal direction. As a result of pivoting the mounting bracket 301 at the base, and using a grade ram 306 acting horizontally or near horizontally at a portion of the mounting bracket distal to the pivot 302, a relatively small adjustment to the extension of the grade ram 306 may effect a relatively large corresponding tilt/pivot by the mounting bracket 301. By this arrangement, the screed assembly, operatively connected to the mounting bracket 301 via the screed mount 310, may be efficiently adjusted in grade by a minimal adjustment to the grade ram 306. Such an arrangement may simplify the overall assembly and minimize the space required by the ram and the overall assembly as well as potentially minimizing the energy requirements to adjust the grade of the screed assembly 300.

Attached to the mounting bracket 301 is a screed mount 310 designed to couple with the screed assembly 300. By this arrangement, the screed assembly 300 may be said to be operatively connected to the mounting bracket 301. Disposed between flanges at the top and bottom of the mounting bracket 301 are vertical guide rails/first guide rails 303. Vertical collars/first collars 304 extending from one side of the screed mount 310 are configured in sliding attachment with the vertical guides 303 such that the screed mount 310 can move along the vertical guides 303 relative to the mounting bracket 301. A hydraulic ram termed the depth ram 307 may act between the screed mount 310 and a portion of the solids handling assembly 200 or the mounting bracket 301 to affect movement of the screed mount 310 relative to the solids handling assembly 200. In the depicted embodiments one end of the depth ram 307 is attached to a flange extending from the bottom of the mounting bracket 301 and the other end is attached to a flange extending from the top of the screed mount 310 orientated between the vertical collars 304. The depth ram 307 is orientated vertically such that the screed mount 310 can articulate with respect to the vertical. When the screed assembly 300 is coupled to the screed mount 310, vertical movement of the screed mount 310 by the depth rams 307 will also articulate the screed assembly 300 with respect to the vertical. By this arrangement, the depth ram 307 controls the height of the screed assembly 300 and consequently the thickness/depth of the asphalt mat formed by the screed.

In the embodiment of the figures, two vertical guide rails 303 are positioned in rigid attachment with the mounting bracket 301, though other embodiments with a different number of guide rails is within the scope of the invention. Each of these vertical guide rails 303 is in sliding attachment with two vertical collars arranged around the outer circumference of the rails and spaced apart by some distance. This arrangement provides a very strong and adjustable attachment that may help distribute the weight of the screed assembly 300. Such a strong and adjustable attachment may be particularly useful for allowing greater extension of the screed assembly 300 from the screed mount 310, and may also allow for the use of a heavier and more robust screed assembly, as a heavier and more extended screed assembly would result in a greater force/stress being applied to the vertical guide rails 303 and collars 304. Furthermore, by using two collars to facilitate sliding attachment with each guide rail, collars of a lower thickness may be used, simplifying the attachment compared to using a thicker/longer sleeve style attachment instead of thin collars, for example. In some embodiments, more than two collars may be used for each guide rail. In some embodiments, a single collar for each rail may suffice.

The screed assembly 300 includes one or more horizontal guide rails 309 spanning the length of the screed assembly 300. The horizontal guide rails 309 runs through horizontal collars 311 extending from the screed mount 310. In the depicted embodiment, the horizontal collars 311 locate on the opposite side of the screed mount 310 to the vertical collars 304. The collars 311 support the weight of the guide rails 309 and hence the screed assembly 300 to which they are fixably attached. The collars 311 also allow the guide rails 309 to slide therethrough thus allowing the horizontal position of the screed assembly 300 to be adjusted. A hydraulic ram termed the extension ram 308 acts between the screed mount 310 and the screed assembly 300 in a horizontal configuration. As the extension ram 308 is actuated the position of the screed assembly 300 is also adjusted horizontally with respect to the screed mount 310, with the guide rails 309 of the screed assembly 300 sliding through the collars 311. By this arrangement the extension of the screed assembly 300 beyond the periphery of the solids handling assembly 200 can be adjusted. Otherwise stated, the extension ram 308 can adjust the extension/width of the screed assembly 300 beyond the discharge end 209 of the conveyor 205. Adjusting the extension of the screed assembly 300 from the solids handling assembly 200 allows the width of the asphalt mat shaped by the screed assembly 300 to be similarly adjusted.

In the embodiment of the figures, two horizontal guide rails 309 are positioned in rigid attachment with the screed assembly 300. Each of these horizontal guide rails 309 is in sliding attachment with two horizontal collars 311 arranged around the outer circumference of the rails and spaced apart by some distance. This arrangement provides a very strong and adjustable attachment that may help distribute the weight of the screed assembly 300. Such a strong and adjustable attachment may be particularly useful for allowing greater extension of the screed assembly 300 from the screed mount 310, and may also allow for the use of a heavier and more robust screed assembly, as a heavier and more extended screed assembly would result in a greater force/stress being applied to the horizontal guide rails 309 and collars 311. Furthermore, by using two collars 311 to facilitate sliding attachment with each guide rail, collars of a lower thickness may be used, simplifying the attachment compared to using a thicker/longer sleeve style attachment instead of thin collars, for example. In some embodiments, more than two collars may be used for each guide rail. In some embodiments, a single collar for each rail may suffice.

In certain embodiments, the screed assembly 300 may be extendable in a direction essentially parallel to the longitudinal axis of the conveyor 205. In other embodiments, the screed assembly 300 may be extendable in a direction offset from the longitudinal axis of the conveyor 205 by an angle such that the distal end of the extended screed assembly 300 trails the end of the screed assembly 300 proximal to the solids handling assembly 200. Otherwise stated, the horizontal guide rails 309 may be configured with an angle to the longitudinal axis of the conveyor 205 and the hopper 201, with the angle opening towards the discharge end 209 of the conveyor 205. The angle may be between about 3° to about 10° or between about 5° to about 10°. In some embodiments, the angle may be configured at about 6°. In some embodiments the offset angle may be configured so that when the screed assembly 300 is extended to about 1500 mm, the distal end of the screed assembly 300 trails the proximal end by about 150 mm. The offset of the screed assembly 300 may effectively fan out asphalt ahead of the screed assembly and plate 313, which may require less force than the screed meeting the asphalt at a direction normal to the advancing direction of the paver 100. The offset of the screed assembly 300 may also encourage asphalt dispersion to the distal end of the screed assembly 300 which is proximal to the screen 318 by meeting the asphalt at an angle, an may thereby aid the screed assembly 300 in laying wider asphalt mats.

Positioned along the length of the bottom periphery 312 of the screed assembly 300 is a screed plate 313. The screed plate 313 is used to mold the asphalt into shape in order to form an asphalt mat. In this embodiment, the screed plate 313 is a piece of steel plate bent into a generally U-shaped profile with a generally flat horizontal section 314 bending smoothly into generally vertical sections 315. The bottom section 314 provides a smooth face to flatten the asphalt as it is extruded underneath, providing a smooth finish to the surface of the asphalt. Provision of a radius of some curvature between the horizontal section 314 and the vertical section 315 of the screed plate 313 may help prevent the asphalt mat being formed from being torn by a sharp transition.

The U-shaped profile of the screed plate 313 defines an inner cavity 316. By passing hot air or combustion exhaust gases through this inner cavity 316, the screed plate 313 can be heated, which leads to easier shaping of the asphalt and reduces stickiness between the asphalt and the screed plate 313 which may reduce instances of tearing of the surface of the asphalt mat.

To produce hot gases for heating the screed plate 313, a small combustor 317 may be located within the cavity 316. The combustor 317 may be fueled by natural gas from a gas bottle, which may be located underneath a stair access platform 105 extending from the rear of the solids handling assembly. A spark plug ignites a mixture of natural gas and air in the combustor 317 to produce hot combustion gases that are passed through the inner cavity 316 of the screed plate 313. The spark plug may be powered from the battery of the skid steer vehicle coupled to the paver 100, or from a battery mounted to the paver 100.

Extending from the distal portion of the screed assembly 300 is a screen 318 to contain the asphalt with the paving site. The screen 318 acts as a barrier to prevent asphalt from being pushed from the far edge of the screed plate 313 and thus removed from the site to be paved. The height of the screen 318 can be adjusted as necessary and the screen 318 may be mounted on springs to allow the screen to move over obstacles. In the depicted embodiments, the screen 318 is adjustable by hand cranks.

In certain embodiments, the screed assembly 300 may include an auger arrangement 319 to encourage the distribution of paving material across the site to be paved. The auger arrangement 319 may be particularly advantageous when paving a relatively wide site such that paving material is encouraged towards the far end of the site proximal to the screen 318. The auger arrangement 319 may be disposed inwardly from the screen 318 such that it extends from the screen 318 towards the solids handling assembly 200. The auger arrangement 319 may be configured to be substantially parallel to the screed plate 313 and in front of the screed plate 313. In certain embodiments, the auger 319 may be of a length of about 500 mm to about 600 mm, although other lengths may be used depending on the width of the mat to be paved. In certain embodiments, the diameter of the auger may be about 250 mm to about 300 mm and may be positioned such that the lowest portion of the auger 319 is about 100 mm from the level of the flat bottom section 314 of the screed plate 313.

The auger arrangement may be rotated by a motor 320 such that paving material may be entrained between the helical blades 321 of the auger arrangement 319 and advanced towards the screen 318 as the auger arrangement 319 rotates. The motor 320 may be disposed on the opposite side of the screen 318 to the auger arrangement 319 and configured with a quick change hub so that the auger arrangement 319 may be quickly removed or attached to the motor 320. Allowing the auger arrangement 319 to be quickly removed/replaced from the motor 320 may facilitate the quick replacement of the auger arrangement 319 or the quick removal of the auger arrangement 319 if it is no longer required. The auger arrangement 319 may also be removed if the screed arrangement 300 is to be retracted so as not to interfere with the solids handling assembly 200.

In certain embodiments, the motor 320 powering the auger arrangement 319 may be fed from the same hydraulic circuit as the conveyor such that the auger arrangement 319 will only rotate when the conveyor 205 is running.

The combined action of the grade ram 306, the depth ram 307 and the extension ram 308 may control the dimensions of the asphalt mat formed by the paver 100 by controlling the position of the screed assembly 300. By adjusting the position of the screed assembly 300, the topographic surface of the asphalt mat is also adjusted. Asphalt discharged to the paving site by the conveyor 205 is spread across the length of the advancing screed plate 313, and extrudes underneath the screed plate, thus molding the mat into shape. By adjusting the extension of the screed assembly 300 by the extension ram 308, the length of the screed assembly for the asphalt to spread across is also adjusted, thus adjusting the width of the asphalt mat formed. Similarly, setting the height of the screed assembly 300 by adjusting the depth ram 307 controls the distance between the paving site and the screed plate 313, thus adjusting the thickness of the asphalt mat extruded from underneath the screed plate 313. Also, by adjusting the tilt of the screed assembly 300 by the grade ram 306, the angle of the screed plate 313 with respect to paving site is adjusted, thus setting the grade of the asphalt mat formed by the screed plate 313. In the embodiment of the figures, the extension of the screed assembly 300 can be adjusted to produce an asphalt mat with a width of between about 0.3 to 1.5 m. The grade can be adjusted between about −5% to +5%. The thickness of the mat can be set to between about 25 to 150 mm. Other embodiments may allow for different parameters to that of the embodiment of the figures by minor alteration of the described arrangements. For example, extending the length of the screed assembly 300 as well as the horizontal guide rails 309 and the horizontal extension ram 308 may allow for a screed assembly 300 that is extendible beyond 1.5 m, allowing the paver 100 to lay a wider mat, for example, a mat with a 2 m width.

Advantageously, this adjustment can be made in real time as the paver 100 is advancing. By way of example, the paver 100 may be used to lay an asphalt road shoulder of a certain width according to a client specification. At certain points along the shoulder, however, may be obstacles such as telegraph poles of road lights. As the paver 100 is advanced, the extension of the screed assembly 300 can be reduced to avoid and pave around the obstacles without having to stop and manually reset the adjustment of the screed assembly 300, or steer the paver 100 away from the obstacle. Similarly, as the paver 100 is being used to lay a road shoulder around a bend, the screed assembly 300 can be extended to continuously pave that portion of the shoulder to be wider.

Usually, the position of the screed assembly 300 would first be set by using the grade ram 306 to set the angle of the screed assembly 300. Once the correct grade is set, the grade ram 306 would be isolated to prevent altering the angle of the screed assembly 300. Then, the extension and height of the screed assembly 300 would be set by the extension ram 308 and depth rams 307 respectively. These rams would not be isolated such that they can be adjusted as the paver 100 advances to produce a asphalt mat of varying thickness and width over the length of the mat. This allows to thickness and width of the mat to be adjusted according to any variable geometry in the road whilst maintaining a constant grade.

In a preferred embodiment, control of the paver 100 is achieved by remote control. For example, solenoids controlling the hydraulic rams and the conveyor may be operable via a 12 v DC radio receiver. This allows for an operator to operate the paver while positioning themselves at a safe distance from the paver and coupled skid steer vehicle, as well as the tipper truck. The conveyor drive may also be fitted with a variable speed control operable from the remote control to control the rate at which asphalt is delivered to the paving site. The remote control may be configured to start and stop the conveyor and to control the positioning of the screed assembly 300 via the hydraulic rams.

In an embodiment, the controls of the paver 100 may be locatable inside the cabin of the skid steer vehicle propelling the paver such that the operator of the skid steer vehicle may also operate the paver 100. A camera mounted to the paver 100 may be used image the site to be paved and to communicate this image to a visual display inside the cabin of the skid steer vehicle such the operator of the skid steer vehicle may make adjustments to the controls of the paver 100 in response to real time conditions. A similar camera and display arrangement may be used to image the hopper of the paver, such that operator of the skid steer vehicle may have visual confirmation that the hopper is sufficiently full and that the conveyor is feeding correctly such that the operation of the paving process may be adjusted accordingly.

Situated at a rear portion of the paver 100 is a drive system coupling 104 configured to couple with the skid steer loader. The drive system coupling 104 provides for rigid attachment of the paver 100 to the skid steer. The drive system coupling may be configured with multiple attachment points to shift the balance of the paver as required for optimal operation due to variable such as the type of drive system/skid steer used, geography of paving site and the material being paved.

Located nearby the drive system coupling are two hydraulic couplings 106 to provide hydraulic power to the paver 100. These couplings 106 are attached to the hydraulic drive of the skid steer by hoses. Swivel wheels 103 may be located beneath the solids handling assembly 200 to help support the weight of the paver 100 when it is attached to the skid steer vehicle as well as aiding the maneuverability of the paver 100. A stair access platform 105 may be located to the rear of the solids handling assembly 200 and may be configured to cover part of the screed assembly 300 as well as the hydraulic rams and screed mount 310 and mounting bracket 301. In this configuration, the stair access platform 105 may allow an operator to access the top of the paver 100 while protecting the operator from moving parts and pinch points. A safety emergency stop may be located on the paver, for example in the vicinity of the stair access platform to isolate the electrical and fluid power of the paver.

The hydraulic system used by the paver may be a modular hydraulic system with a proportional four bank valve bank employing a DPC 130 series inlet. The hydraulic system may employ an unloader valve with manual override twist lock and all rams and other hydraulic components may be fitted with counterbalance valves. The motor spool for the conveyor may be configured to operate at about 80 lpm (liters per minute) and the motor spool for the hydraulic rams may be configured to operated at about 10 lpm. The hydraulic system may also be configured with a manual override system to allow manual control of the paver in the event of remote control malfunction. Manual override may be effected by turning a valve in the proportional four bank valve bank.

The paver 100 hereinbefore described is particularly suited for laying a continuous asphalt mat of significant length. As the hopper 201 is sized to completely encompass the width of the tray of a tipper truck, the tipper truck can continuously deliver asphalt to the paver 100 as the paver advances forward. When the tipper truck is in position to deliver asphalt to the hopper 201, the rollers 102 locate against the rear wheels of the tipper truck. By this arrangement, the tipper truck can be placed into neutral gear and propelled forward by the paver 100 as it in turn is propelled forward by the skid steer vehicle. As the rollers 102 push against the tipper truck tyres, the rollers 102 rotate in sympathy with the tipper truck tyres, allowing them to rotate and the tipper truck to move forward. By advancing the tipper truck in unison with the paver 100 and coupled skid steer, the tipper truck can continuously feed material to the hopper 201 allowing the paver to lay a long and uninterrupted asphalt mat.

To prepare a site for paving by the paver 100 of the present invention, it is sufficient to use a profiler rather than heavy excavation equipment. After the site is profiled, the paver 100 can be used to produce an asphalt mat. The mat can subsequently be rolled by a roller to finish the surface.

In a simplified embodiment to that described above, the paver may be configured without the ability of adjust the position of the screed assembly in depth and grade such that only the extension/width of the screed assembly may be adjusted. In such an arrangement, the screed assembly is attached to the solids handling assembly by way of a screed mount that is configured with the horizontal collars 311 that accommodate the horizontal guide rails 309 of the screed assembly as herein before described. However, the screed mount is not configured with the vertical collars 304, and is rigidly attached to the solids handling assembly rather than being coupled to a mounting bracket 301 by way of the vertical guide rails 303. Accordingly, by doing away with the mounting bracket 301 as well as the vertical collars and vertical guide rails, and by rigidly attaching the screed mount to the solids handling assembly, the screed assembly of the resultant paver will only be adjustable in extension/width. Such an embodiment may provide for a simpler and less expensive paver that may be beneficial for paving applications that do not require adjustability in the depth and grade of the screed assembly. Also, such an arrangement may only require controls for the conveyor and the extension of the screed assembly, such that the controls may be provided locally to the paver for manual adjustment, rather than by remote control.

Many modifications will be apparent to those skilled in the art without departing from the scope of the present invention.

The invention claimed is:

1. A paver mountable to a vehicle to provide propulsion and hydraulic power to the paver, wherein the paver includes:

- a drive system coupling for mounting the vehicle to the paver;
- hydraulic mounts to connect with hydraulic power from the vehicle;
- a solids handling assembly for receiving paving material and for delivering paving material to a paving site;
- a screed assembly with a screed plate which is hydraulically adjustable in extension, height and grade;
- a mounting bracket operatively connected to the screed assembly;
- a first hydraulic ram;
- a screed mount operatively connected to the mounting bracket and to the screed assembly, wherein the screed mount includes one or more first collars in sliding attachment with one or more first guide rails, said first guide rails being rigidly attached to the mounting bracket such that the first hydraulic ram acts on the screed mount to adjust the position of the screed mount along the first guide rails to adjust the height of the screed assembly;

wherein, paving material delivered to the paving site is shaped by the screed assembly as the paver is propelled forward to produce a paved surface.

2. A paver according to claim 1, wherein the vehicle is a skid steer vehicle.

3. The paver according to claim 1, wherein the mounting bracket is pivotably attached to the solids handling assembly, and wherein the mounting bracket may be tilted about the pivotable attachment to adjust the grade of the screed assembly.

4. The paver according to claim 3, wherein a second hydraulic ram acts on the mounting bracket to tilt the mounting bracket, and wherein the second hydraulic ram is powered by the hydraulic power of the vehicle.

5. The paver according to claim 1, wherein the first hydraulic ram is powered by the hydraulic power of the vehicle.

6. The paver according to claim 1, wherein the mounting bracket includes one or more second collars in sliding attachment with one or more second guide rails, said second guide rails being rigidly attached to the screed assembly such that the position of the screed assembly may be adjusted relative to the screed mount by sliding the second guide rails through the second collars to adjust the extension of the screed assembly.

7. The paver according to claim 6, wherein a third hydraulic ram acts between the screed assembly and the screed mount to adjust the position of the screed assembly relative to the screed mount, and wherein the third hydraulic ram is powered by the hydraulic power of the vehicle.

8. The paver according to claim 1, wherein the solids handling assembly includes a hopper for receiving paving material from a tipping truck;

a conveyor fed by the hopper;

one or more rollers for contacting with the tyres of a tipping truck when the tipping truck is in position for loading paving material to the hopper.

9. The paver according to claim 8, wherein the hopper and conveyor are sized to accommodate the full span of the tipper truck.

10. The paver according to claim 8, wherein when the tipper truck is in position against the one or more rollers, the tipper truck can be propelled in unison with the paver by a force applied by the paver which is in turn propelled by the vehicle.

11. The paver according to claim 1, wherein the screed plate has a generally U-shaped profile and an internal cavity.

12. The paver according to claim 11, wherein hot gases are passed through the internal cavity to heat the screed plate.

13. The paver according to claim 12, wherein the hot gasses are produced by combusting LPG in a combustor within the cavity.

14. The paver according to claim 1, including an auger assembly arranged adjacent to a portion of the screed plate, where rotation of the auger assembly is configured to transport paving material in the paving site to a portion of the paving site distal to the solids handling assembly.

15. The paver according to claim 1, wherein the screed assembly may be configured with a longitudinal axis at an angle to a longitudinal axis of the solids handling assembly.

16. A paver mountable to a vehicle to provide propulsion and hydraulic power to the paver, wherein the paver includes:

a drive system coupling for mounting the vehicle to the paver;

hydraulic mounts to connect with hydraulic power from the vehicle;

a solids handling assembly for receiving paving material and for delivering paving material to a paving site;

a screed assembly with a screed plate which is hydraulically adjustable in extension from the solids handling assembly;

wherein, paving material delivered to the paving site is shaped by the screed assembly as the paver is propelled forward to produce a paved surface, and wherein the paver includes a screed mount fixedly attached to the solids handling assembly and configured with one or more collars in sliding attachment with one or more guide rails fixedly attached to a mounting bracket, which is operatively connected to the screed assembly such that the height of the screed assembly is hydraulically adjustable by sliding the guide rails through the collars.

17. A paving method using the paver of claim 1, wherein a vehicle is coupled to the drive system coupling and to the hydraulic mounts, wherein the tipper truck is positioned against the paver such that the rear tyres of the tipper are in contact with the one or more rollers such that as the vehicle propels the paver forward the one or more rollers push against the tyres of the tipper truck thus moving the tipper truck in unison with the paver and vehicle, the method comprising the steps of operating the tray of the tipper truck to supply the hopper with paving material;

transferring the paving material from the hopper to the paving site by the conveyor;

shaping of the paving material by the screed plate as the paver is propelled forward.

18. A paving method using the paver of claim 16, wherein a vehicle is coupled to the drive system coupling and to the hydraulic mounts, wherein the tipper truck is positioned against the paver such that the rear tyres of the tipper are in contact with the one or more rollers such that as the vehicle propels the paver forward the one or more rollers push against the tyres of the tipper truck thus moving the tipper truck in unison with the paver and vehicle, the method comprising the steps of operating the tray of the tipper truck to supply the hopper with paving material;

transferring the paving material from the hopper to the paving site by the conveyor;

shaping of the paving material by the screed plate as the paver is propelled forward.

* * * * *